US005689476A

United States Patent [19]

Leach

[11] Patent Number: 5,689,476

[45] Date of Patent: Nov. 18, 1997

[54] TELEPHONE COST MONITOR

[76] Inventor: Terrence T. Leach, 9850 Cordoba Ct., Apartment 3A, Orland Park, Ill. 60462

[21] Appl. No.: 441,987

[22] Filed: May 16, 1995

[51] Int. Cl.[6] ..... G04B 47/00

[52] U.S. Cl. ..... 368/10; 368/107

[58] Field of Search ..... 368/10, 13, 97, 368/223, 4, 107–113

[56] References Cited

U.S. PATENT DOCUMENTS

| | | | |
|---|---|---|---|
| 3,555,193 | 1/1971 | Brand | 368/97 |
| 3,813,533 | 5/1974 | Cone et al. | 368/223 |
| 3,882,670 | 5/1975 | Woolley | 368/4 |
| 3,962,548 | 6/1976 | Stone, Jr. | 368/13 |
| 3,970,793 | 7/1976 | Profitt et al. | 368/13 |
| 4,075,829 | 2/1978 | Goff | 368/13 |
| 4,079,201 | 3/1978 | Scott et al. | 368/13 |
| 4,195,220 | 3/1980 | Bristol et al. | 368/46 |
| 4,228,644 | 10/1980 | Watanabe et al. | 368/28 |
| 4,260,855 | 4/1981 | Rubinstein | 368/4 |
| 4,340,808 | 7/1982 | Donohoo | 368/96 |
| 4,427,300 | 1/1984 | Groothuis | 368/37 |

*Primary Examiner*—Bernard Roskoski
*Attorney, Agent, or Firm*—Terrance L. Siemens

[57] ABSTRACT

A hand-held, battery powered, portable monitor for recording elapsed time and for calculating cost charges based upon this elapsed time. The monitor selectively displays constantly updated elapsed time and constantly updated charges which accrue with elapsed time. A clock generates a data signal relating to elapsed time, and a memory device is provided with data relating to charges accruing with respect to the elapsed time. A calculator employs stored data to calculate constantly updated accrued charges, and to generate a corresponding data signal. The data signals regarding current elapsed time and current charges are received by a display, and these values are displayed. The device includes a keypad for entering data and operating commands, a battery power source, and an on-off switch. The memory can store cumulative elapsed time and cost data. The monitor provides information regarding the cost of employing a device, such as a telephone, for which usage costs accrue with the passage of time elapsing during usage. An optional alarm signals attainment of a predetermined time interval and of a predetermined cost value, so that the user can make an informed decision regarding continued use of the device. The monitor reports data both for the current usage, and also for all usages during a longer term time period. Stored data can be cleared to reflect new individual usages, and new longer time periods.

1 Claim, 2 Drawing Sheets

TELEPHONE COST MONITOR

BACKGROUND OF THE INVENTION

CROSS REFERENCE TO RELATED DISCLOSURE DOCUMENT

This invention was disclosed in Information Disclosure Document No. 365,703, filed with the United States Patent and Trademark Office on Nov. 22, 1994.

1. Field of the Invention

The present invention relates to apparatus for metering and annunciating time elapsing during an activity, and concurrently calculating and annunciating costs associated with this activity. The apparatus includes a memory device, a calculator, and a keypad for entry of pertinent data and commands. Most advantageously employed to monitor costs of telephone usage, the device records time elapsing during a telephone call, and can determine equivalent toll charges. Time and cost data are annunciated on a display.

2. Description of the Prior Art

Certain activities associated with costs based upon elapsed time of use are frequently undertaken. Persons availing themselves of the apparatus or service so provided may wish to be apprised constantly or periodically of cumulative costs of the apparatus or service. This is particularly true if the basis for the charge is known, but duration of usage cannot be predicted.

A principal example is that of utilizing telephone service. The service may be a long distance connection, or may be usage of a portable or cellular telephone, for which charges accumulate with elapsed time during which the cellular telephone is in use. Even though it is easy for a caller to ascertain the basis for toll charges, it does not follow that during an actual call, the caller will enjoy similar control over the actual costs.

This is so for several reasons. One is that immediate conversion of time to toll charges is not readily available. Another is that in most cases, duration of a telephone call cannot be predetermined with certainty that critical information be exchanged within a predetermined time interval, with the consequence that duration of the telephone call is a variable.

Portable, hand held, self-powered devices for storing and retrieving data are well known. With reference to the field of telephone usage, an example is seen in U.S. Pat. No. 3,555,201, issued to Manfred R. Kuehnle on Jan. 12, 1971. The device described in this patent is an automatic dialer which has memory for storing telephone numbers. The device can be controlled to dial these numbers from an individual telephone set. There is no provision for handling or calculating telephone charges, nor is there any provision for annunciation or display of data.

A portable device for storing, manipulating, and displaying data is shown in U.S. Pat. No. 5,210,853, issued to Masataka Nakasuji et at. on May 11, 1993. This device is directed to providing information normally available in a printed dictionary, and allied information related to language usage. The device appears to incorporate storage of telephone numbers and to possess simple calculating ability, although these two latter functions are in no way linked. There is no description of annunciation of an ongoing calculation which changes with passage of time.

A hand held device for monitoring prices is described in U.S. Pat. No. 5,111,196, issued to Peter F. Hunt on May 5, 1992. This device is intended for displaying accurate pricing information. This device is dependent upon having its memory loaded with pricing data. There is no measurement of elapsed time associated with this display, nor calculation of associated charges. There is also no provision for manual loading of uncomplicated pricing data.

Small, hand held devices for storing and displaying data are shown in U.S. Design Pat. Nos. 301,885, issued to Keiko Takemata et al. on Jun. 27, 1989, 317,921, issued to Toru Suzuki on Jul. 2, 1991, and 339,139, issued to Terrance K. Jones et al. on Sep. 7, 1993. These devices, which share the characteristic of having electronic memory devices and keypads for entry of data and commands, are apparently directed towards assisting in recall and dialing of telephone numbers. There is no teaching of calculating charges or of monitoring elapsed time.

An example of a device for monitoring constantly increasing charges is seen in taxi meters. However, taxi meters are not readily associated with a device for monitoring and annunciating accruing telephone or like charges. Taxi meters may base their charges upon miles covered or geographic zones negotiated rather than purely upon passage of time. Such meters are not portable and hand held, and are not capable of signalling predetermined specified values. Also, no keypad or like manual apparatus is provided to enter relevant data for calculating accruing charges.

None of the above inventions and patents, taken either singly or in combination, is seen to describe the instant invention as claimed.

SUMMARY OF THE INVENTION

The present invention provides a portable, hand-held device for monitoring charges accruing with elapsed time. The device includes memory and data processing apparatus, for receiving and processing data and commands. A display annunciates derived charges and, if desired, measured elapsed time. Optionally, an audible or other signal is provided to warn of a predetermined threshhold value being attained. The device can store data pertaining to each individual usage, and provide cumulative time and charges data coveting many usages.

A significant application of the invention is to monitor the cost of telephone or like communications equipment usage, where such usage incurs charges based upon elapsed time of use. For example, long distance service and cellular service may be monitored by the novel apparatus.

Individual telephone users normally have no means to advise on an up to date basis the charges accruing during a telephone call. The present invention is manually controlled to measure time elapsing during a call, and to convert this measurement into a cost calculation, the results of which may be constantly displayed. Thus, the user is immediately informed as to what the charges are at any point in his or her conversation, and may therefore make a decision as to when to terminate the call.

A longer term record is made of time and cost, so that weekly, monthly, or other relevant periods may be assessed with respect to cumulative or total time spent and charges accrued during the relevant time period. This information may assist a telephone user in adhering to a budget, planning future budgets, and verifying the accuracy of charges submitted by the telephone company.

The device has keypad buttons for entering a toll charge rate in monetary units such as dollars and cents, for measuring elapsed time, for displaying elapsed time and charge totals for the current call and cumulative totals for the longer time period covering a number of prior calls, and for clearing information in memory in order to start a new time period.

A display displays, selectively, accrued time elapsed and charges. In addition, a warning is incorporated so that a predetermined value can be annunciated when that value is reached. This enables a user to adhere to a predetermined limit associated with telephone usage, and to make decisions as to when to terminate the conversation.

The device is compact, portable, and hand-held, in the sense of being similar to a hand-held pocket calculator. Of course, it is not necessary that the device actually be supported in the user's hand during use, but rather that this be possible. The device includes well known electronic components, such as memory and keypad components, which are well known, being employed in pocket calculators, in the devices detailed in the above referenced patents, and other commercially available consumer data handling products.

The device preferably has a power storage battery and an on-off switch to conserve battery power. With the on board battery and with keypad data entry, the device remains independent of external connections, such as to electrical power, to a database, to an external control system, and to an external calculator. The device may thus be carried about, and employed with any telephone device, rather than being associated with only one such telephone device.

Accordingly, it is a principal object of the invention to provide a portable, hand-held device for measuring elapsed time and simultaneously calculating costs or charges that vary with the elapsed time.

It is another object of the invention to display the elapsed time and charges to the user, so that the user is immediately informed as to up to date time elapsed and accrued charges.

It is a further object of the invention to record and display elapsed time and cost values which accrue during a number of individual usages over a time period.

Still another object of the invention is to be able to clear cumulative elapsed time and cost values, so that a new time period may be measured and similar values recorded on a cumulative basis.

An additional object of the invention is that the device carry on board a power supply, so that it remains independent of external connections.

It is again an object of the invention to provide a signal marking passage of a predetermined time or cost interval occurring since commencement of the current telephone usage.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
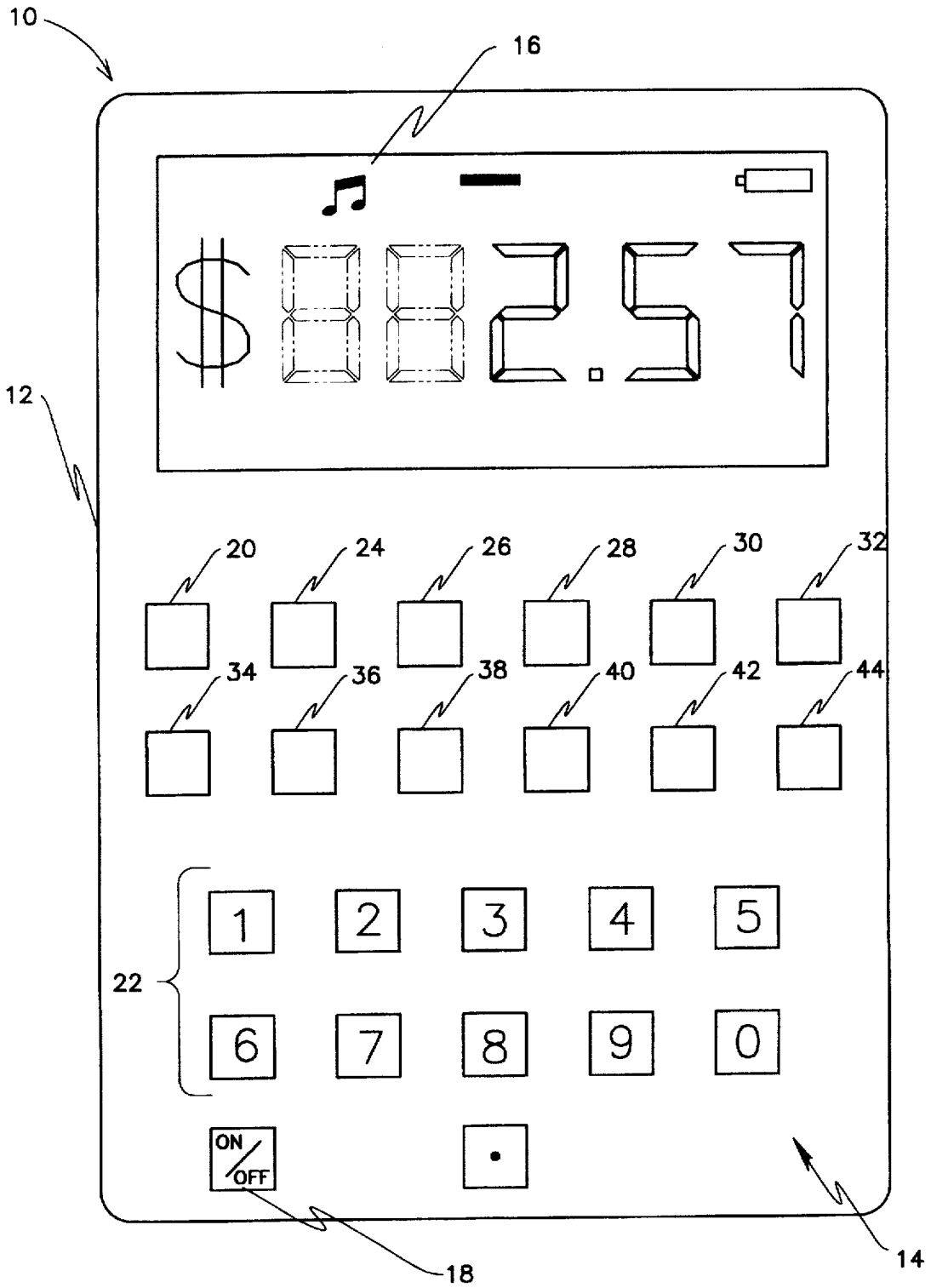
FIG. 1 is a top plan view of exterior of the invention.
Figure 2:
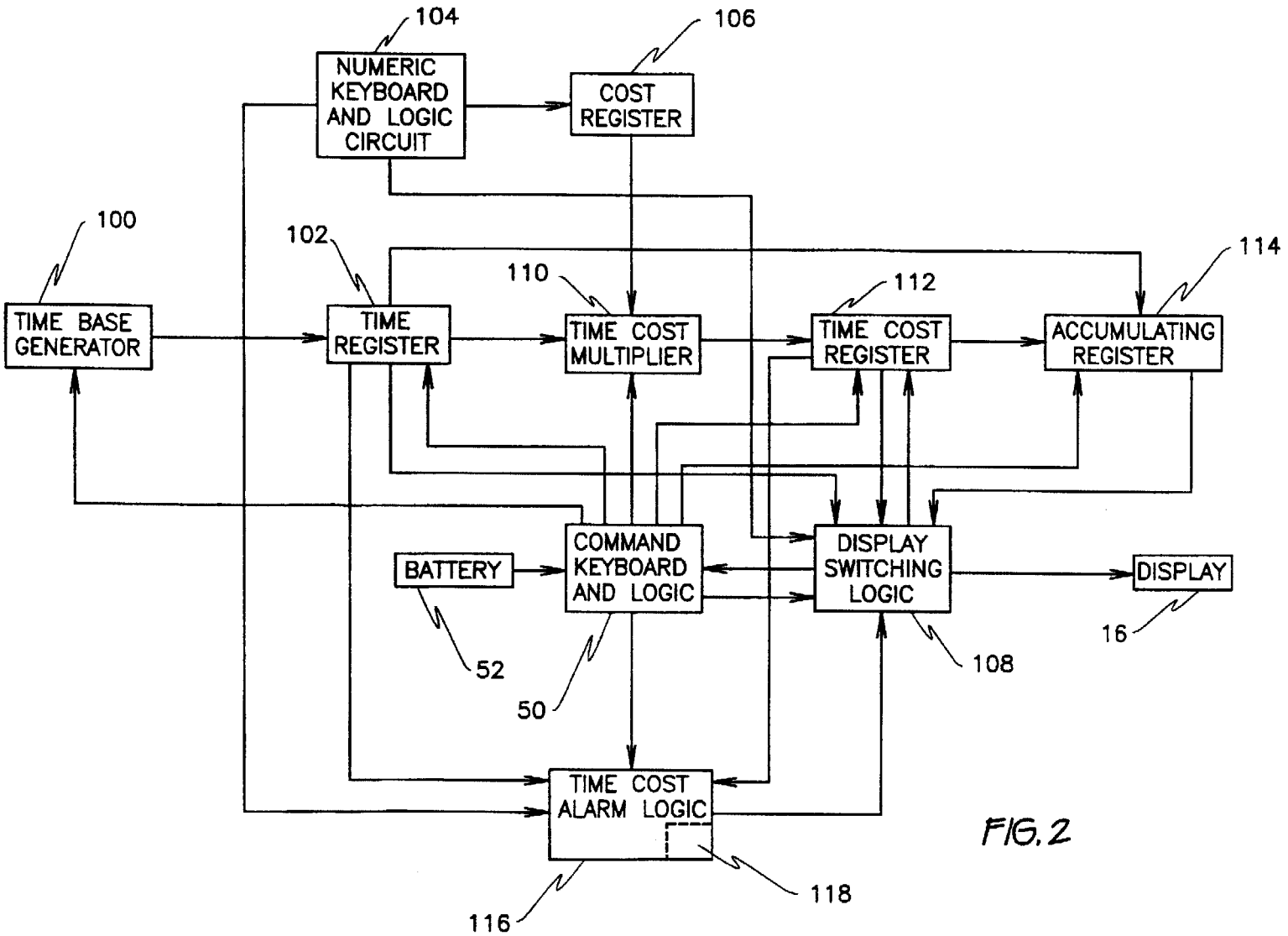
FIG. 2 is a schematic showing interrelationships among the components of the invention.

The novel time use cost monitor 10, shown in FIG. 1, combines known digital electronics components to build a device housed in a singular housing 12, having an external keypad 14, display 16, and on-off switch 18. External, individual keys are also illustrated in FIG. 1, and internal components of monitor 10 are shown in the schematic of FIG. 2.

A functional overview of monitor 10 reveals the following components. An elapsed time clock measures time elapsing during use of the device, generating a data signal corresponding to current elapsed time, and this data is stored in memory.

Memory also records cost basis values. Cost basis values signify charges for each time unit of operation, which charges will eventually be levied by the provider of the apparatus or service being monitored.

A data entry apparatus in the form of keypad 14 enables individual operating or function commands to be entered, and also numerical values corresponding to the cost basis values. Conventional switches operated by individual keys of keypad 14 are provided. These switches, and their respective buttons for operating the switches will be referred to as keys for brevity.

A calculator processes data corresponding to elapsed time and to cost basis values, thereby deriving a current accrued cost. Throughout this description, elapsing time and derived costs applying to the usage occurring simultaneously with operation of the time clock will be referred to as current elapsed time and current accrued costs.

Monitor 10 also has the ability to store cumulative elapsed time and accrued cost data in memory, each individual usage being added either automatically or by command. Cumulative values will enable the user to monitor an arbitrary time period including individual usages, and idle periods. This is appropriate for, illustratively, financial record keeping purposes, since services such as telephone companies generally submit bills on a monthly basis. It will frequently be useful to the user to correlate time and cost values representing the sum of individual usages for comparison with the submitted bill.

The calculator therefore determines current time and cost data and generates corresponding data signals, which are entered into and retrieved from memory responsive to appropriate commands entered by depressing individual keys, or other data entry elements.

Display 16 is preferably a liquid crystal display annunciating desired time and cost data, either current or cumulative, responsive to appropriate commands.

Monitor 10 has a power source, preferably a battery. Power of the battery is conserved by turning switch 18 to "off" when monitor 10 is not in use.

Optionally, monitor 10 includes an alarm for annunciating completion of predetermined time interval. For example, the user may wish to monitor a telephone call and make a decision to curtail the call after a predetermined time period. The alarm indicates when this predetermined time interval has elapsed. Alternatively, the user may wish to base the decision on the basis of cost rather than on the basis of elapsed time. The alarm can be made responsive to a predetermined current accrued cost value by an appropriate command.

The various controls may include the following keys in any desired combination. On-off switch 18 may automatically initiate time clock operation, or a separate starting key 20 may be provided for this purpose. The cost basis value may be entered on the numerical keys 22, which include the ten basic digits plus a decimal point, after depressing key 24. Display of current elapsed time may be automatic, or activated by a key 26. Switching the display to show current accrued costs may be accomplished by depressing a key 28. Further switching the display to indicate cumulative elapsed time and cumulative accrued costs may be performed by operating keys 30,32, respectively.

An advisory key 34 may be employed to initiate the alarm advising of a predetermined time interval, which can then be entered into memory by numerical keys 22. Key 34 may be operated by depressing the same twice to select the option to advise of a predetermined current accrued cost. Alternatively, another key (not shown) may be provided to accomplish this. Regardless of whether the advisory alarm responds to time or to a cost value, the alarm feature includes logic for causing the time clock to generate a signal corresponding to completion of the time interval responsive to the appropriate command, and for causing the calculator to generate a signal corresponding to attainment of the predetermined current accrued cost value.

Either signal will activate the alarm, which could be a visual signal appearing upon display 16 or indicated by a dedicated lamp (not shown), or which could be an audible display generated by a buzzer, voice synthesizer, or other sound source (not shown) or any combination of the above. Entry of the numerical value of the predetermined time interval is completed by pressing a key 40. Similarly, a key 42 completes the command for annunciation of a predetermined current accrued cost.

A reset key 36 clears the current time and accrued cost data from memory, so that the memory is reset for storing new current time and cost data. Similarly, a key 38 clears the memory of cumulative time and accrued cost data in preparation of starting a new long term time period for monitoring.

Current time and accrued cost data may be automatically added to memory of cumulative data, or this may be performed by a key 44 dedicated to this purpose.

It must be noted that dedicated keys, or the precise scheme described above for accomplishing the commands recited above are not critical, as long as there is provision for the respective functions to be initiated on demand. This may be accomplished by varying the nature of the switch, such as providing a toggling logic switch, requiring more than one depression to achieve an alternate function, requiring a combination of keys to be actuated simultaneously, and providing a multiposition switch, among others. Also, some functions may proceed automatically.

To assemble monitor 10, either conventional TTL or/CMOS level logic chips can be combined, or a dedicated, integrated circuit chip can be fabricated to provide basic data storage and processing. Keyboard 14, shown in FIG. 1, controls all functions, and has suitable command logic, indicated at 50 in FIG. 2, for generating appropriate commands responsive to pressing individual keys. A battery 52 is connected through switch 18 (shown only in FIG. 1) to command logic 50.

Operation will be described principally with reference to FIG. 2, it being recalled that individual numeric and control keys are shown in FIG. 1. A time base generator 100 generates a regular or periodic pulse output when operating, and no output when not operating. Pulse signals corresponding to seconds and minutes are transmitted to a time register 102, which receives and sums pulses, and stores this count as data in memory in the time register logic circuit. This process is initiated preferably by switching on monitor 10 by switch 18, which may be a key dedicated to this purpose, as is commonly practiced with pocket calculators.

Time register 102 is able to count seconds from zero to fifty-nine and minutes from one to nine hundred ninety-nine. The sixtieth count would generate a conversion to minutes and hours, respectively. Time register 102 can be controlled by keys 26 and 28 to display current elapsed time and current accrued cost. Alternatively, a key controlling a toggling switch may alternate these two displays.

Key 24 would be pressed to activate numeric keys 22 which have an associated numeric logic circuit, shown schematically at 104 for entering the cost per time unit value, which would be in monetary units, into a cost register 106. In a preferred embodiment, activating numeric logic automatically causes a display switching logic 108 to display the cost per time unit value. The operator verifies this value, then inputs the value by pressing key 24 again.

A time cost multiplier logic circuit 110 calculates current accrued costs by multiplying the current elapsed time value from time register 102 by the cost per time unit value from cost register 106, and transmitting the calculated value to a time-cost register 112.

Time-cost register 112 is switched by display switching logic 108 to display current accrued cost automatically, or by key 28. Current data is cleared by utilizing reset key 36, which also clears current elapsed time data from time register 110.

A record of cumulative elapsed time and cumulative accrued costs is maintained either automatically, or by utilizing key 44, which will add the final current value to an accumulating register 114. This action may clear memory of time register 102 and time-cost register 112 automatically, or this function may be performed by pressing accumulator reset key 38. Cumulative accrued costs may be reviewed by pressing key 32, which will route the output of accumulating register 114 to display 16. Preferably, clearing cumulative costs will cause display 16 to indicate a zero value to confirm the transaction.

The alarm feature is activated by utilizing advisory key 34, which operates in conjunction with a time-cost alarm logic circuit 116. The desired value is entered into numeric keyboard 104, followed by depression of key 34. Further depression of either key 26 or key 28 will then control the alarm feature to signal arrival of a time interval predetermined by the desired value just entered into numeric keyboard 104, or arrival of a current accrued cost value, respectively. Arrival of the critical value, regardless of whether time or cost is being advised, can be annunciated by temporarily displaying a predetermined message on display 16, or by actuating an alarm 118, which may be audible, visual or a combination of audible and visual.

Obviously, variations on the inventive concept will occur to those of skill in the art. Illustratively, it may be desired that the control keys be minimized to reduce complexity of operating monitor 10. On the other hand, more keys may be provided in order to lend additional versatility to monitor 10.

It is to be understood that the present invention is not limited to the embodiments described above, but encompasses any and all embodiments within the scope of the following claims.

I claim:

1. A time use cost monitor for determining the cost of using a device for which time use costs accrue during use, said cost monitor comprising:

an elapsed time clock for measuring time elapsing during use of the device, and generating a data signal corresponding to current measured elapsed time;

data memory for storing data relating to both elapsed time and cost basis values;

data entry apparatus for entering operating commands and cost basis values;

a calculator for processing data corresponding to both elapsed time and to said cost basis values, and for deriving data corresponding to current accrued costs responsive to both data relating to elapsed time and data relating to cost basis values, and for generating a second data signal corresponding to said accrued costs, said calculator operating responsive to commands entered in said data entry apparatus;

a display for displaying data relating to said elapsed time data signals and said second data signal corresponding to said accrued costs; and a power source for operating said monitor, comprising a battery and an on-off switch for conserving power of said battery, said data entry apparatus further including a reset key, for clearing said memory of data relating to current elapsed time and current accrued costs, and for resetting said memory to store new data relating to current accrued costs and current elapsed time, said data entry apparatus including a key for entering a command to display cumulative accrued costs, a key for entering a command to display cumulative elapsed time, an accumulator key for adding data corresponding to current elapsed time and to current accrued costs to data stored in said memory, an accumulator reset key for entering a command to clear said memory of cumulative accrued cost data and cumulative elapsed time, and for resetting said memory to store new data relating to cumulative accrued cost data and cumulative elapsed time, and an advisory key for entering, selectively, a command to signal completion of a predetermined time interval, and a command to signal attainment of a predetermined current accrued cost value, said elapsed time clock having means for generating a signal corresponding to completion of said predetermined time interval responsive to said command to signal completion of said predetermined time interval, and said calculator having means for generating a signal corresponding to attainment of said predetermined current accrued cost value responsive to said command to signal attainment of said predetermined current accrued cost value, said monitor further comprising an alarm responsive to signalling of completion of a predetermined time interval and to signalling of attainment of a predetermined current accrued cost value.

* * * * *